United States Patent [19]

Sinclair

[11] Patent Number: 4,538,818

[45] Date of Patent: Sep. 3, 1985

[54] SHUTTLECOCK

[75] Inventor: J. Andrew Sinclair, London, England

[73] Assignee: Zimm Zamm AG, Baar, Switzerland

[21] Appl. No.: 506,474

[22] Filed: Jun. 21, 1983

[30] Foreign Application Priority Data

Jun. 21, 1982 [ZA] South Africa ..... 82/4359

[51] Int. Cl.[3] ..... A63B 67/18

[52] U.S. Cl. ..... 273/417; 273/58 K; 273/61 C

[58] Field of Search ..... 273/417, 61 R, 61 C, 273/29 A, 58 K

[56] References Cited

U.S. PATENT DOCUMENTS

| | | | |
|---|---|---|---|
| 2,009,759 | 7/1935 | Brown | 273/417 |
| 2,016,252 | 10/1935 | McNamara | 273/417 |
| 2,613,935 | 10/1952 | Richards | 273/417 |
| 3,069,170 | 12/1962 | Dillon | 273/61 R X |
| 3,507,494 | 4/1970 | Finkel | 273/417 X |
| 4,101,128 | 7/1978 | Yellen | 273/29 A X |

FOREIGN PATENT DOCUMENTS

| | | | |
|---|---|---|---|
| 887172 | 1/1962 | United Kingdom | 273/417 |
| 1386484 | 3/1975 | United Kingdom | 273/417 |

*Primary Examiner*—Paul E. Shapiro

*Attorney, Agent, or Firm*—Cushman, Darby & Cushman

[57] ABSTRACT

The invention provides a large shuttlecock which can be used with a variety of bats or racquets for a game resembling badminton or a game combining the pleasure of badminton and tennis in that the spherical head portion has a size comparable to a standard tennis ball and is designed to bounce, the shuttlecock having a spherical or partially spherical head portion made from at least an outer layer of closed cell polymeric material of predetermined parameters relating to cell size, density, tensile strength and an elongation at break and having a skirt formation attached to it in association with a core unit which increases the average density of the spherical head portion to a predetermined value.

2 Claims, 2 Drawing Figures

SHUTTLECOCK

FIELD OF THE INVENTION

Figure 1:
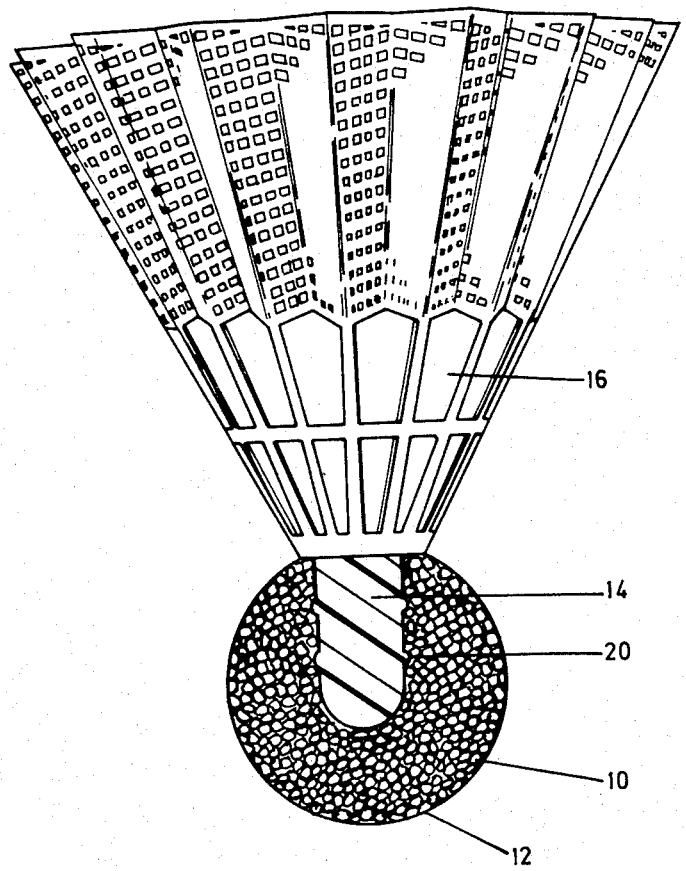

This invention relates to a combination of a spherical or parially spherical body and a skirt formation which constitute a large shuttlecock for a game resembling badminton.

OBJECT OF THE INVENTION

It is an object of the invention to provide such a large shuttlecock with the spherical or partially spherical portion being made from a particular foamed polymeric material which has good bounce and flight characteristics and a good "feel" when struck.

DEFINITIONS OF THE INVENTION

According to the invention a large shuttlecock for a game resembling badminton comprises in combination a spherical or partially spherical having a diameter of 5–15cm head portion and a skirt formation, the spherical or partially spherical formation being made from a closed cell foamed polymeric material having an average cell size of from 0.3 mm to 0.7 mm, a tensile strength of between 250 and 400 and kn/m$^2$ (at 345 Kn per square meter), an elongation at break at between 100 and 300 percent, a density of between 0.030 and 0.075 gm/cm$^3$ and having a inner core unit of size and/or density for the overall average density of the spherical or partially spherical portion to be between 0.010 and 0.20 gm/cm$^3$.

In a preferred form of the invention the inner core unit has a diameter of 1 to 4 cm and preferably about 3 cm with a mass of about 15 gm. The density of the foamed polymeric material is preferably about 0.055 gm/cm$^3$ and the preferred overall average density of the core and foamed polymeric material is preferably in the region of 0.15 gm/m$^2$.

Water absorption by the foamed polymeric material is avoided by the closed cell nature of the polymer material. Alternatively, the spherical or partially spherical portion may be provided with a skin of the same or different material.

The closed cell nature of the ball ensures fire-proofing if carbon dioxide or sulphur dioxide is the foaming agent. It is therefore safe for children and if it bounces from a fire to the floor no fire will be started.

In an embodiment of the invention the polymeric material is a blend of natural or synthetic rubber ethylene vinyl acetate having a cell size of 0.5 mm, a tensile strength of 300 kn/m$^2$, an elongation at break of 200 percent, and a density of about 0.055 gm/cm$^3$. The core unit may be made from the same or a different polymer of density about 0.85 and having a diameter of b 2.8 cm. The overall mass of the spherical portion is from about 15 to 30 gm, having a diameter of 7.0 cms and therefore a mean density from about 0.10 to 0.20 gm/cm$^3$. The blend of ethylene vinyl acetate and natural or synthetic rubber or similar resilient material contains preferably from about 2 to 50 percent (and more preferably 30 to 50 percent by mass of the blend) of rubber and 50–70 percent of ethylene vinyl acetate having an average cell size of 0.45–0.55 mm.

It will be appreciated that fillers, pigments, anti-oxidants and like substances may be added to the blend.

The core may be off-set from the exact centre of the spherical or partially spherical portion but it should be located on the vertical axis of the shuttlecock so as to secure optimum flight characteristics.

The unexpected impact characteristics of the shuttlecock of the present invention are such that a excellent "feel" is imparted when striking the shuttle and its good bounce characteristics allow it to be played on the half-volley or having bounced thus providing a game that combines the pleasure of tennis as well as badminton.

In one embodiment of the invention, the attachment or anchoring means for fastening the skirt to the ball comprises an extension of the skirt which is inserted into the ball. This extension may be weighted or made relatively dense so as to provide the relatively dense core of the spherical or partially spherical portion when so assembled.

Figure 2:
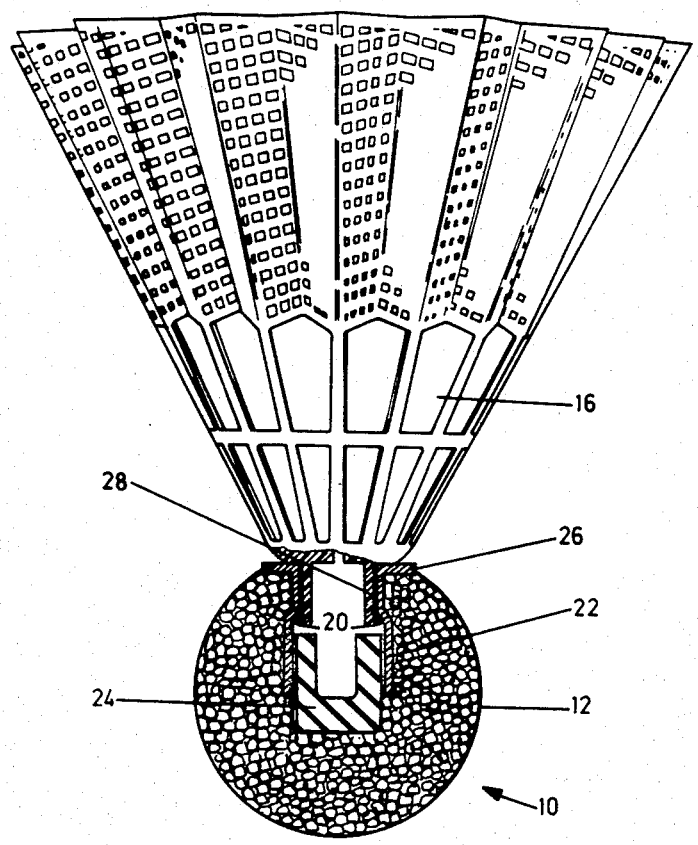

An embodiment of the invention is illustrated in the accompanying drawings, in which:

FIG. 1 is a sectional side view through a shuttlecock according to the present invention; and FIG. 2 is a similar view through a modified form of the invention.

Referring to both Figures the spherical head portion 10 (which is really partially spherical and may be even more partially spherical in other embodiments) comprises a closed cell foamed polymeric outer layer 12, the polymer having the characteristics as outlined above, and a core 14 (FIG. 1) or assembly 28,20,24 (FIG. 2) made from a material of sufficiently greater density than that of the polymer layer 10, that the spherical portion has a desired or predetermined density.

It is preferred that the diameter of the spherical portion is about 7 cm to approximate to the size of a standard tennis ball but it will be appreciated that the diameter of the spherical portion may be greater or smaller than this.

The choice of the polymeric material and particularly as regards its density, resiliency and Shore Hardness is such that a soft object is obtained which can be used for games using any type or form of bats or racquets or even bare hands.

In FIG. 1 skirt 16 is made from a polymeric material and formed into the configuration resembling a badminton shuttlecock. It has a depending formation 14 (the core) adapted to be inserted into a hole of the spherical portion 10. The formation 14 may be made from rubber or any other suitable material to ensure that the spherical portion has a predetermined or desired density. The formation 14 may be solid or hollow and filled with suitable ballast. The formation 14 may have raised portions 20 for anchoring purposes. These may take the form of a circumferential ribs or may be a helix. The formation 14 is not necessarily at the spherical centre of the spherical portion but is on the vertical axis of the combination spherical portion and skirt for regular flight characteristics.

Referring to FIG. 2 a modified anchor arrangement between skirt and spherical portion comprising plastic sleeve 22 and a relatively heavy immediate ballast insert (core) 24 of resilient rubber-like or synthetic material is provided. The mass and/or size of the insert 24 is carefully chosen so as to provide the required optimum overall density of the complete unit. The skirt 16 has an integral depending formation 28 which has a circular lip 20 which is designed to lock into a complimentary formation on the sleeve 22. Obviously other methods can be used to secure the skirt 16 to the sleeve 22 which can also be integral with the ballast insert 24 and made from the same material or secured directly to ballast insert 24.

The skirt 16, sleeve 22 and ballast insert 24 are inserted into the spherical portion 10 where this sub-assembly is frictionally held and may be withdrawn to facilitate changing of units in the case of need for replacement.

The sleeve 22 has a flange 26 which is designed to prevent the migration of the skirt into the ball on repeated impact. The sleeve 22 is capable of being opened when removed from the spherical portion (for example by means of a slot extending vertically downwardly from the flange 26) so as to facilitate the insertion of the depending formation 28 of the skirt 16. Insertion of the assembly of skirt, sleeve and ballast insert into the spherical portion ensures the positive locking of the depending formation 28 of the skirt 16 into the sleeve 22.

The sleeve 22 is waisted below flange 26 to aid its frictional locking into the spherical portion 12.

Apart from the parameters discussed above, another parameter is pertinent, namely the Shore Hardness of the surface of the spherical portion which should be not more than about 15.

I claim:

1. A shuttlecock for use in a game resembling badminton but which, to the usual characteristics of badminton of returing the shuttlecock through the air by striking it with a racquet before the shuttlecock has touched he ground, adds the unusual characteristic of returning the shuttlecock through the air by striking it with a racquet after the shuttlecock has touched once on the ground and has rebounded to a striking height, similar to the usual characteristic of tennis ball rebounding and play in the usual game of tennis, said shuttlecock comprising:

a head which is substantially spherically curved throughout a substantial portion of the external periphery thereof including throughout a forward, nose portion and an axially intermediate portion; and a skirt member including a relatively thin-walled rearwardly flaring generally frusto-conical skirt with a head core portion secured at a forward end thereof;

said head including an axially rearwardly opening socket in a trailing portion thereof, said socket extending axially forwardly within said head along the longitudinal axis of said shuttlecock, to a level located at least approximately half-way through the head;

said head core of said skirt member being secured in said socket so that said skirt extends coaxially rearwardly from said trailing portion of said head as a skirt for said shuttlecock;

said head being made of closed-cell polmeric foam having an average cell size of 0.3–0.7 mm, a tensile strength of 250–400 kn/m$^2$, an elongation at break of 100–300 percent, a density of 0.03–0.075 gm/cm$^3$, a Shore hardness of less than 15, and a diameter of 5–15 cm;

said head core having a density of 0.8–0.9 gm/cm$^3$, and a diameter of 1.5–4.0 cm; and said head core and said head together constituting a head assembly having an overall mass of 15–30 gm, and a mean density of 0.10–0.2 gm/cm$^3$.

2. The shuttlecock of claim 1, wherein:

said closed-cell polmeric foam is a blend of from 30–50 percent by weight of rubber to 50–70 percent by weight of ethylene vinyl acetate having an average cell size of 0.45–0.55 mm, a tensile strength of 250–350 kn/m$^2$, an elongation at break of 150–250 percent, a density of 0.045–0.065 gm/cm$^3$; and a diameter substantially equal to that of a standard tennis ball; and said head assembly has a mean density of 0.10–0.15 gm/cm$^3$.

* * * * *